US009367985B2

(12) United States Patent
Dempsey et al.

(10) Patent No.: US 9,367,985 B2
(45) Date of Patent: Jun. 14, 2016

(54) SYSTEM FOR PROVIDING AN INTERFACE FOR A GAMING DEVICE

(75) Inventors: Martin Dempsey, Las Vegas, NV (US); Jeffrey George, Las Vegas, NV (US); Edward Sepich, Henderson, NV (US); Thomas E. Soukup, Las Vegas, NV (US)

(73) Assignee: KONAMI GAMING, INC., Las Vegas, NV (US)

( * ) Notice: Subject to any disclaimer, the term of this patent is extended or adjusted under 35 U.S.C. 154(b) by 1270 days.

(21) Appl. No.: 11/276,315

(22) Filed: Feb. 23, 2006

(65) Prior Publication Data

US 2007/0060312 A1 Mar. 15, 2007

Related U.S. Application Data

(63) Continuation-in-part of application No. 10/661,128, filed on Sep. 12, 2003, now abandoned.

(60) Provisional application No. 60/656,813, filed on Feb. 25, 2005, provisional application No. 60/656,818, filed on Feb. 25, 2005, provisional application No. 60/659,720, filed on Mar. 8, 2005.

(51) Int. Cl.
*A63F 9/24* (2006.01)
*G07F 17/32* (2006.01)

(52) U.S. Cl.
CPC ..... *G07F 17/32* (2013.01); *G07F 17/3227* (2013.01); *G07F 17/3239* (2013.01)

(58) Field of Classification Search
CPC ..... A63F 9/24; A63F 13/00; A63F 1/00
USPC ..... 463/1, 16–20, 25, 29–33, 42; 273/138.1, 148 R
See application file for complete search history.

(56) References Cited

U.S. PATENT DOCUMENTS

| | | | |
|---|---|---|---|
| 4,339,798 | A | 7/1982 | Hedges et al. |
| 5,038,022 | A | 8/1991 | Lucero |
| 5,116,055 | A | 5/1992 | Tracy |
| 5,265,874 | A | 11/1993 | Dickinson et al. |
| 5,280,909 | A | 1/1994 | Tracy |
| 5,321,241 | A | 6/1994 | Craine |
| 5,342,047 | A | 8/1994 | Heidel et al. |
| 5,429,361 | A | 7/1995 | Raven et al. |
| 5,457,306 | A | 10/1995 | Lucero |
| 5,470,079 | A | 11/1995 | LeStrange et al. |
| 5,472,194 | A | 12/1995 | Breeding et al. |
| 5,564,700 | A | 10/1996 | Celona |
| 5,611,730 | A | 3/1997 | Weiss |
| 5,655,961 | A | 8/1997 | Acres et al. |
| 5,702,304 | A | 12/1997 | Acres et al. |
| 5,752,882 | A | 5/1998 | Acres et al. |
| 5,762,552 | A | 6/1998 | Vuong et al. |
| 5,770,533 | A | 6/1998 | Franchi |
| 5,800,268 | A | 9/1998 | Molnick |
| 5,800,269 | A | 9/1998 | Holch et al. |

(Continued)

*Primary Examiner* — Jason Skaarup
(74) *Attorney, Agent, or Firm* — Howard & Howard Attorneys PLLC

(57) ABSTRACT

A device for providing an interface to a gaming machine. The device includes a processor, an ID Card reader coupled to the processor, a display coupled to the processor for displaying a bezel and information within the bezel. The device also including a keypad coupled to the processor for receiving input. The processor instructing the display to display media according to a predetermined set of rules.

20 Claims, 3 Drawing Sheets

(56) References Cited

U.S. PATENT DOCUMENTS

| | | | |
|---|---|---|---|
| 5,811,772 | A | 9/1998 | Lucero |
| 5,820,459 | A | 10/1998 | Acres et al. |
| 5,836,817 | A | 11/1998 | Acres et al. |
| 5,841,183 | A | 11/1998 | Ariyoshi |
| 5,851,149 | A | 12/1998 | Xidos et al. |
| 5,855,515 | A | 1/1999 | Pease et al. |
| 5,876,284 | A | 3/1999 | Acres et al. |
| 5,885,158 | A | 3/1999 | Torango et al. |
| 5,902,983 | A | 5/1999 | Crevelt et al. |
| 5,911,626 | A | 6/1999 | McCrea, Jr. |
| 5,919,091 | A | 7/1999 | Bell et al. |
| 5,952,640 | A | 9/1999 | Lucero |
| 5,959,277 | A | 9/1999 | Lucero |
| 5,967,896 | A | 10/1999 | Jorasch et al. |
| 6,001,016 | A | 12/1999 | Walker et al. |
| 6,012,984 | A | 1/2000 | Roseman |
| 6,019,283 | A | 2/2000 | Lucero |
| 6,039,648 | A | 3/2000 | Guinn et al. |
| 6,048,269 | A | 4/2000 | Burns et al. |
| 6,068,552 | A | 5/2000 | Walker et al. |
| 6,071,190 | A | 6/2000 | Weiss et al. |
| 6,077,162 | A | 6/2000 | Weiss |
| 6,080,062 | A | 6/2000 | Olson |
| 6,089,982 | A | 7/2000 | Holch et al. |
| 6,093,103 | A | 7/2000 | McCrea, Jr. |
| 6,110,043 | A | 8/2000 | Olsen |
| 6,110,044 | A | 8/2000 | Stern |
| 6,117,011 | A | 9/2000 | Lvov |
| 6,117,012 | A | 9/2000 | McCrea, Jr. |
| 6,146,273 | A | 11/2000 | Olsen |
| 6,162,122 | A | 12/2000 | Acres et al. |
| 6,183,362 | B1 | 2/2001 | Boushy |
| 6,183,366 | B1 | 2/2001 | Goldberg et al. |
| 6,203,010 | B1 | 3/2001 | Jorasch et al. |
| 6,206,782 | B1 | 3/2001 | Walker et al. |
| 6,210,275 | B1 | 4/2001 | Olsen |
| 6,257,981 | B1 | 7/2001 | Acres et al. |
| 6,371,852 | B1 | 4/2002 | Acres |
| 6,416,411 | B1 | 7/2002 | Tsukahara |
| RE37,885 | E | 10/2002 | Acres et al. |
| 6,511,377 | B1 | 1/2003 | Weiss |
| 6,558,255 | B2 | 5/2003 | Walker et al. |
| 6,682,421 | B1 | 1/2004 | Rowe et al. |
| 6,729,618 | B1 | 5/2004 | Koenig et al. |
| 6,800,029 | B2 | 10/2004 | Rowe et al. |
| 6,848,996 | B2 | 2/2005 | Hecht et al. |
| 6,857,959 | B1 | 2/2005 | Nguyen |
| 6,863,608 | B1 | 3/2005 | LeMay et al. |
| 6,866,585 | B2 | 3/2005 | Muir |
| 6,884,165 | B2 | 4/2005 | Baerlocher |
| 6,887,157 | B2 | 5/2005 | LeMay et al. |
| 2002/0052235 | A1 | 5/2002 | Hirsch et al. |
| 2002/0142825 | A1 | 10/2002 | Lark et al. |
| 2002/0142846 | A1 | 10/2002 | Paulsen |
| 2002/0151357 | A1 | 10/2002 | Acres |
| 2002/0155887 | A1 | 10/2002 | Criss-Puszkiewicz |
| 2002/0156692 | A1 | 10/2002 | Squeglia et al. |
| 2002/0165023 | A1 | 11/2002 | Brosnan et al. |
| 2002/0173354 | A1* | 11/2002 | Winans et al. ..... 463/20 |
| 2003/0013532 | A1 | 1/2003 | Rowe et al. |
| 2003/0028480 | A1 | 2/2003 | Rowe |
| 2003/0032479 | A1 | 2/2003 | LeMay et al. |
| 2003/0054868 | A1 | 3/2003 | Paulsen et al. |
| 2003/0054881 | A1* | 3/2003 | Hedrick ..... G07F 17/0014 463/29 |
| 2003/0064805 | A1 | 4/2003 | Wells |
| 2003/0067112 | A1 | 4/2003 | Grauzer et al. |
| 2003/0109306 | A1 | 6/2003 | Karmarkar |
| 2003/0148812 | A1* | 8/2003 | Paulsen et al. ..... 463/42 |
| 2003/0153381 | A1 | 8/2003 | Slattery |
| 2003/0176213 | A1 | 9/2003 | LeMay et al. |
| 2003/0199295 | A1 | 10/2003 | Vancura |
| 2003/0211878 | A1 | 11/2003 | Walker et al. |
| 2003/0211881 | A1 | 11/2003 | Walker et al. |
| 2003/0224858 | A1 | 12/2003 | Yoseloff et al. |
| 2004/0014515 | A1 | 1/2004 | Tracy et al. |
| 2004/0023709 | A1 | 2/2004 | Beaulieu et al. |
| 2004/0053658 | A1 | 3/2004 | Rothranz |
| 2004/0082384 | A1 | 4/2004 | Walker et al. |
| 2004/0106449 | A1 | 6/2004 | Walker et al. |
| 2004/0106454 | A1 | 6/2004 | Walker et al. |
| 2004/0127284 | A1 | 7/2004 | Walker et al. |
| 2004/0137978 | A1 | 7/2004 | Cole et al. |
| 2004/0142747 | A1 | 7/2004 | Pryzby |
| 2004/0204228 | A1 | 10/2004 | Walker et al. |
| 2004/0214628 | A1 | 10/2004 | Boyd et al. |
| 2005/0014552 | A1 | 1/2005 | Packes, Jr. et al. |
| 2005/0020342 | A1 | 1/2005 | Palmer et al. |
| 2005/0043090 | A1 | 2/2005 | Pryzby et al. |
| 2005/0054441 | A1 | 3/2005 | Landrum et al. |
| 2005/0075167 | A1 | 4/2005 | Beaulieu et al. |
| 2005/0096125 | A1 | 5/2005 | LeMay et al. |
| 2007/0265094 | A1* | 11/2007 | Tone ..... G07F 17/32 463/42 |

* cited by examiner

SYSTEM FOR PROVIDING AN INTERFACE FOR A GAMING DEVICE

CROSS-REFERENCE TO RELATED APPLICATIONS

The present application claims priority to U.S. Provisional Application Ser. No. (60/656,813), filed Feb. 25, 2005; U.S. Provisional Application Ser. No. (60/656,818), filed Feb. 25, 2005; U.S. Provisional Application Ser. No. (60/659,720), filed Mar. 8, 2005 and is a continuation-in-part application of U.S. patent application Ser. No. 10/661,128, filed Sep. 12, 2003, all of which are hereby incorporated by reference.

FIELD OF THE INVENTION

The present invention relates generally to gaming machines, and more particularly, to a system and method for providing a player interface to a player of a gaming machine.

BACKGROUND OF THE INVENTION

The growth and competition in the casino gaming market in recent years and the increasingly sophisticated and complex technology being integrated into the gaming environment, at the individual game, casino management, and auditing levels, presents both challenges and opportunities to game manufacturers, gaming establishment operators, and regulatory agencies. The technological capabilities and requirements of, for example, advanced electronic games, multi-site gaming operations, detailed player tracking, wide area progressive jackpots, and various alternatives to the use of currency and coins by players, all present a potentially huge pool of ever-changing data which can be of great value to casino operators (from a management standpoint) and to regulators from an audit/compliance standpoint.

One area that has received a lot of attention in recent years has been providing added bonuses or incentives to players of electronic gaming machines, such as video slot machines video poker machines. An award may be selected at random or be based on a player's previous level of play. Once a player has met the selected criteria, the award in credits paid from the machine's hopper is released.

Players may also be given an incentive through a player tracking club. Usually, a player is identified during play by a player tracking ID card and/or a player identification number (PIN). The player tracking system tracks the player's play and awards player tracking points according to established criteria. The player tracking points may be redeemed for prizes, such as complimentary meals or merchandise.

Typically, the player track ID card is entered into a player ID card located on the electronic gaming machine. A separate, numeric key pad is used to enter the PIN. Furthermore, a separate display screen may be used to display information, instructions to the player, or media, such as video.

However, standard systems are inflexible and do not provide the casino operator with the maximum benefit and advantages available from the information and systems now available.

The present invention is aimed at one or more of the problems as set forth above.

SUMMARY OF THE INVENTION AND ADVANTAGES

In one aspect of the present invention, a player tracking device for providing a player interface to a player of a gaming machine and displaying media from a media source is provided. The media source provides first and second media content. The player tracking device is coupled to the gaming machine and includes a processor, an ID reader, a display, and a keypad. The ID reader is coupled to the processor. The display is coupled to the processor for displaying information and displaying media. The keypad is coupled to the processor for receiving input. The processor is for displaying the first media on the display and for replacing the first media on the display with the second media in response to receiving input.

In a second aspect of the present invention, a player tracking device for providing a player interface to a player of a gaming machine and displaying media from a media source is provided. The media source provides a first media content stream and a second media content stream. The player tracking device is coupled to the gaming machine. The player tracking device includes a processor, an ID reader, a display and a keypad. The ID reader is coupled to the processor. The display is coupled to the processor for displaying information and displaying media. The keypad is coupled to the processor for receiving input. The processor switches between first and second media content in response to player input on the keypad.

In a third aspect of the present invention, a gaming system is provided. The gaming system includes a media source, and a plurality of gaming machines. The media source provides a first media content stream and a second media content stream. Each gaming machine has a player tracking device capable to play media. The media source and the plurality of gaming machines are networked together. A first set of the gaming machines displays the first media content stream and a second set of the gaming machines displays the second media content stream according to a set of predetermined rules.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

With reference to the drawings and in operation, the present invention provides a system 10 and method for providing a player interface to a player of a gaming machine 12. Gaming machines 12 may include, but are note limited to electronic gaming machines or EGM (such as video slot, video poker machines, or video arcade games), electric gaming machines, virtual gaming machines, e.g., for online gaming, and an interface to a table management system (not shown) for table games.

Figure 1:
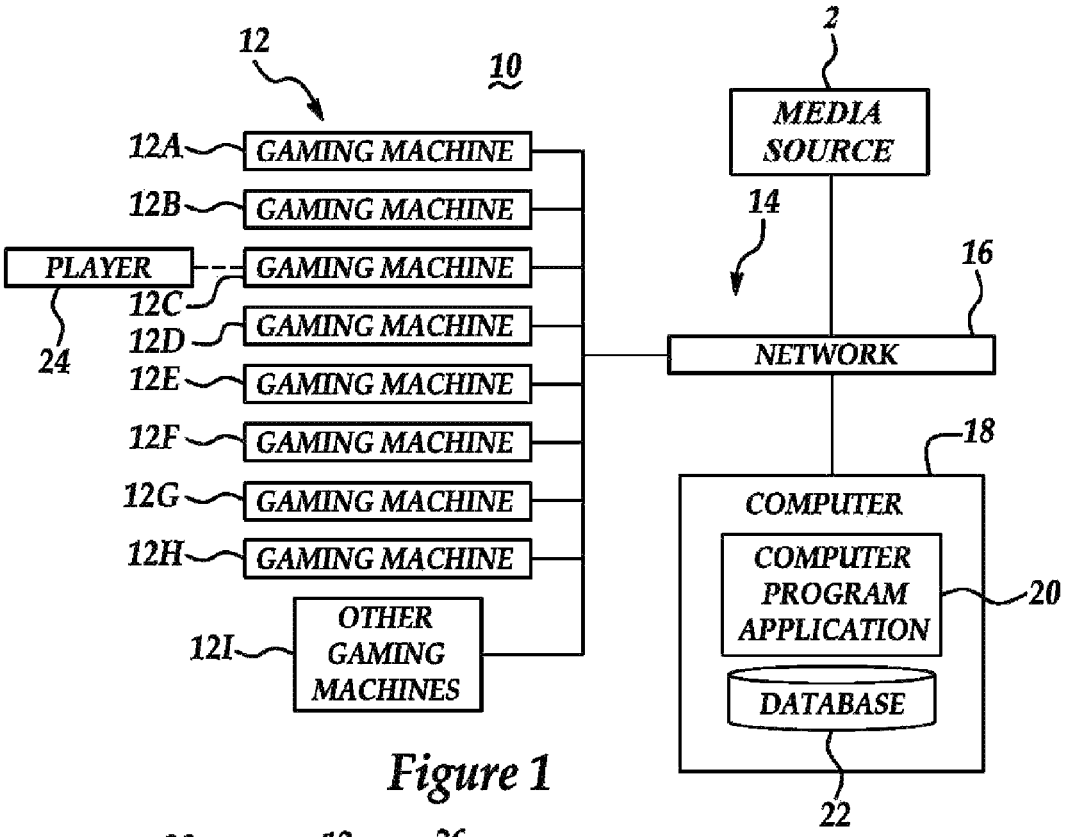
FIG. 1 is block diagram of a system for providing a player interface to a player of a gaming machine, according to an embodiment of the present invention.

In one embodiment, the system 10 and method may be embodied or implemented via an entertaining management and monitoring system 14 which is shown in block diagram form in FIG. 1. The entertainment and monitoring system 14 may include may additional functions such as, real-time multi-site, slot accounting, player tracking, cage credit and vault, sports book data collection, Point of Sale (POS) accounting, keno accounting, bingo accounting, and table game accounting, a wide area progressive jackpot, and electronic funds transfer (EFT). Such systems are disclosed in U.S. patent application Ser. No. 09/967,571. filed Sep. 28, 2001 which is hereby incorporated by reference.

As shown, the system 10 may include a plurality of gaming machines 12. In the illustrated embodiment, eight electronic gaming machines 12A-12H are shown. However, it should be noted that the present invention is not limited to any number or type of machines 12. In one embodiment, the machines 12 are organized into banks (not shown), each bank containing a plurality of machines 12. Other types of gaming machines which may be included (see above) are indicated with reference number 12I.

The gaming machines 12 are connected via a network 16 to one or more host computers 18, which are generally located at a remote or central location. The computer 18 includes a computer program application 20 which maintains one or more databases 22. In one embodiment, the database(s) are Oracle database(s).

The computer program application 20 and databases 22 may be used to record, track, and report accounting information regarding the gaming machines 12 and players of the gaming machines 12. Additionally, the computer program application 20 and databases 22 may be used to maintain information related to player tracking accounts (see below).

In general, the gaming machines 12 are playable by a player 24. The player 24 may select one of the gaming machines 12C to play and insert a coin, credit, coupon, and/or player tracking card (not shown) into the chosen gaming machine 12C. Generally, the gaming machines 12C have an associated number of credits or coins required in order to play. In the case of video slot or poker games, the game is played and an award in the form of credits may be awarded based on a pay table of the gaming machine 12.

Figure 2:
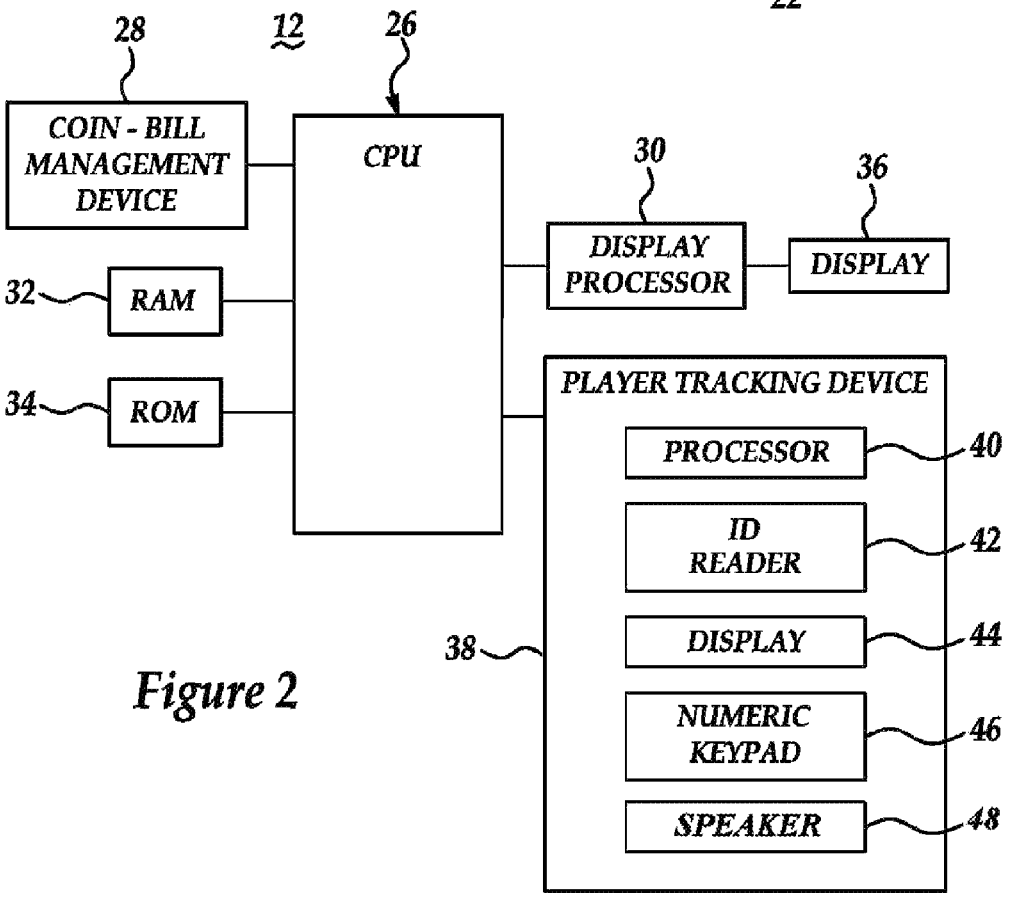
FIG. 2 is a block diagram of a gaming machine for use with the system of FIG. 1.

With reference to FIG. 2, a block diagram of a suitable electronic gaming machine 12C is shown.

The machine 12C comprises a game controller 26, or central processing unit (CPU), a coin-bill management device 28, a display processor 30, a RAM 32 as a memory device and a ROM 34 (generally provided as an EPROM). The CPU 26 is mainly composed of a microprocessor unit and performs various calculations and motion control necessary for the progress of the game. The coin-bill management device 28 detects the insertion of a coin or a bill and performs a necessary process for managing the coin and the bill. The display processor 30 interprets commands issued from the CPU 26 and displays desirable images on a display 36. The RAM 32 temporarily stores programs and data necessary for the progress of the game, and the ROM 34 stores, in advance, programs and data for controlling basic operation of the machine 12C, such as the booting operation thereof, game code and graphics.

Input to the gaming device 12C may be accomplished via mechanical switches or buttons or via a touchscreen interface (not shown). Such gaming machines 12 are well known in the art and are therefore not further discussed.

The player 24 is identified via the player tracking card and/or a player identification number entered into player tracking device 38 at each gaming machine 12 (see below). Player tracking accounts may be used, generally, to provide bonuses to a player, in addition to the award designated by, in the case of a video slot or poker machine, the gaming machine's 12 paytable. These bonuses may be awarded to the player 24 based a set of criteria, including, but not limited to, a) the player's play on the machine 12C, b) the player's overall play, c) play during a predetermined period of time, and d) the player's birthday or anniversary, or e) any other definable criteria. Additionally, bonuses may be awarded on a random basis, i.e., to a randomly chosen player or randomly chosen game 12. Bonuses may also be awarded in a discretionary manner or based on other criteria, such as, purchases made at a gift shop or other affiliated location.

In one embodiment, the player tracking device 38 includes a processor 40, an ID reader 42 and/or a numeric keypad 44, and a display 46. In one embodiment, the display 46 is a touchscreen panel and the numeric keypad 44 is implemented thereon.

The player tracking device 38 includes an ID reader 42. The ID reader 42 will typically a sensor and/or reader for sensing the presence (or absence) of an article which is used to identify a particular player. The ID reader 42 may be an ID card reader, a biometric sensor for sensing a biometric characteristic of the player, an RFID sensor, or any suitable type of reader or sensor. The article will be a corresponding type of article, such as an ID card, the player's biometric characteristic, e.g., a fingerprint, or RFID chip or transponder. For the purposes of discussion only, the player tracking device 38 illustrated will be discussed with respect to an ID card reader 42 and ID card.

In one embodiment, the ID reader 42 is the numeric keypad 44, requiring only the entry of an personal identification number or PIN. In other embodiment, identification of the player requires the proper article and entry of the PIN.

In the illustrated embodiment, the player 24 may be identified by entry of a player tracking card into the player identification card reader 42 and/or entry of a player identification number (PIN) on the numeric key pad 46. The play tracking device 38 may also be used to communicate information between the computer 18 and the corresponding gaming machine 12C. The player tracking device 40 may also be used to track bonus points, i.e., incentive points or credits, downloaded from the computer 18.

In one aspect of the present invention, the bonuses are awarded as bonus points. In one embodiment, the bonus points are incentive points. In another embodiment, the bonus points are credits.

The incentive points may converted to credits using a predetermined ratio. The predetermined ratio may be 1 or any other desired ratio. The predetermined ratio may also be varied based on determined criteria, e.g., the gaming machine 12 being played, the player, or the time of day. Incentive points may be designated as cashable or non-cashable. As described below, the incentive points in a player account may be downloaded to one of the gaming machines 12 for play.

Incentive points stored in the player account may be designated as cashable or non-cashable. In one embodiment, the player account may include only cashable incentive points. In another embodiment, the player account may include only non-cashable incentive points. In a third embodiment, the player account may include both cashable and non-cashable incentive points.

In still another embodiment, the player account may include incentive points, cashable and/or non-cashable, and credits, cashable and/or non-cashable.

Cashable credits, or incentive points converted into credits, may be downloaded to a gaming machine 12. When the player has finished playing the gaming machine 12, any remaining credits may be cashed out, i.e., retrieved as coins or placed on a printed ticket or player tracking card for redemption or play on another gaming machine 12.

Non-cashable credits must be played. When the player stops playing gaming machine 12C, any remaining non-cashable credits which were downloaded to the gaming machine 12C are either lost or uploaded back to the player account (see below).

The database 22 tracks the player account for each player in the player tracking system. In the illustrated example, the following is tracked for each player: account number, incentive points, name, cashable credits and non-cashable credits. Thus in this example, bonus points in the form of incentive points, cashable credits and non-cashable credits may be awarded.

In one aspect of the present invention, bonus points are awarded via electronic vouchers, i.e., records in the database 22. A voucher is created each time bonus points are awarded. Each voucher has a voucher number and an amount (in the case a dollar or credit amount). Each voucher is assigned to a player account and includes the player account number to which it is assigned. Each voucher may include additional parameters or fields based on the needs of the system 10. For example, an expiration date could be included which gives a date at which the respective voucher expires. The voucher may also designate the bonus points as cashable or non-cashable.

In one aspect of the present invention the computer 18 may create a first voucher and assign a first number of bonus points to the first voucher. The computer 18 may also create a second voucher and assign a second number of bonus points to the second voucher. The first and second vouchers may be assigned to a player account. Each voucher has a parameter. The parameter of the first voucher has a first value and the parameter of the second voucher has a second value.

In one embodiment, the bonus points are incentive points which may be converted to credits and downloaded to the gaming machine 12C.

In another embodiment, the bonus points are credits which may be downloaded to the gaming machine 12C.

In one embodiment, the gaming machine 12C may display to the player 24 a list of the vouchers which have been assigned to their player account. The player 24 may then indicate at least one voucher to download. The list may be displayed whenever appropriate, for example, when the player 24 is identified to the system 10, when the player requests the list (through a menu system), when a new voucher has been created, or any other suitable time. In one embodiment, the list may be displayed on the display 36. In another embodiment, the list may be displayed on the player tracking device display 44.

The first and second values of the parameters of the first and second vouchers 48 may be equal or different. For example, in one embodiment the parameter relates to an expiration date of the respective voucher. The expiration date may be a function of the date of the voucher was created. Thus, the expiration dates of the first and second vouchers may be different if the vouchers were created on different days or may be the same if created on the same day.

In another embodiment, the parameter is one of cashable and non-cashable. The computer 18 may designed a voucher as cashable or non-cashable. Typically, this is defined by predefined criteria based on how the voucher was created.

If the bonus points for a specific voucher are incentive points, the incentive points may be converted to credits prior to downloading to the gamine machine 12C. As described above, this is done using a predetermined ration which may be 1 or some other ratio.

In one embodiment, the gaming machine 12 may provide an indication to the player 24 when the first voucher or second voucher has been assigned to the player account. For example, the indication may be an audio signal and/or a visual signal.

In one embodiment, the parameter may be an expiration date of the respective voucher. Each voucher may also include a second parameter designating the respective bonus points as being cashable or non-cashable.

In one embodiment, the computer 18 may convert the first number of bonus points to a first number of credits and download the first number of credits to the player tracking device 38.

In another embodiment, the gaming machine 12 has a credit meter for tracking available credits for play of the gaming machine by the player 24. The computer 18 may convert the first number of bonus points to a first number of credits and download the first number of credits to the credit meter.

In one embodiment, the parameter may be one lump-sum and pay for play. The computer 18 may convert the first number of bonus points to credits and download the credits to the credit meter if the first voucher is designated as lump-sum.

In one embodiment of the present invention, the gaming machine 12 is capable of accepting a variable wager. The variable wager has a maximum wager value or MAX BET. In one embodiment, the maximum wager value is equal to the lesser of a value defined by the configuration of the gaming machine 12, a value defined by the incentive setup, or the remaining balance of bonus points. The computer 18 converts the first number of bonus points associated with the first voucher to a first number of credits and downloads the first number of bonus points to the player tracking device 38 as credits. The gaming machine 12C allows the player 24 to place a wager and play the gaming machine 12C. The gaming machine 12C decrements the wager from the credit meter, decrements the maximum wager from the player tracking device 38, and credits the maximum wager to the credit meter in response to the player 24 playing the gaming machine 12C.

In another embodiment of the present invention, the player account is credited with a first number of bonus points. The bonus points are downloaded to the player tracking device 38 as credits. The player 24 places a wager and the gaming machine 12 is played. If the total of the player's wagers (over one or more games) is greater or equal to a predetermined value, i.e., a predetermined match play amount, then the match play amount is decremented from the player tracking device 38 and the match play amount is credited to the credit meter. Otherwise, the player 24 may place another wager.

One suitable system for crediting a player with bonus points is described in U.S. patent application Ser. No. (10/661,392), filed concurrently with the present application, which is hereby incorporated by reference.

With reference to FIG. 2, in one aspect of the present invention, the player tracking device 38 provides an interface for interaction between the player 24 or other user (not shown), such as a slot employee or slot technician, and the host computer 18, i.e., player tracking system. As discussed above in one embodiment, the display 44 is a touchscreen display which allows information to be displayed to the player 24 or user, as well as provide interactive buttons or menus for receiving input. Furthermore, the keypad 46 may be implemented on the display 46 and displayed on the display 44 as appropriate or required.

In one aspect of the present invention, the display 44 displays a bezel 50. Other information may be displayed within the bezel 50.

In one embodiment, the bezel 50 includes a modifiable parameter for indicating information, e.g., to a slot employee. The modifiable parameter may be color, but other parameters may be used. For example, the bezel may blink, change colors, or cycle in some other manner to convey information.

In one embodiment, the modifiable parameter may be one of (at least) first and second values which are indicative of predetermined criteria of the player 24. For example, the first value (such as the color red) may be indicative of a hot player and the second value (such as the color blue) may be indicative of a mild player.

If the game machine 12C is not currently being played, the processor 40 may instruct the display 44 to display instructions for inserting a player ID Card into the ID card reader 42. Additionally, the display may play or display other media, e.g., audio and/or video and/or pictures, in a cyclical manner or according to a set of predetermined rules, as discussed further below.

The types of media that may be played on the player tracking device 38 include, but are not limited to local attractions, general in-house advertisements, paid advertisements by local merchants, show reviews, promotional alerts, security alerts, community service advisories, emergency directions, featured videos, a current Keno board. The media may include audio, video, and/or audio and video.

In one aspect of the present invention, the media or media content is provided by one or more media sources 2, e.g., but not limited to, a camera or web camera providing a live video feed or a media server. There may be a single media source 2 or multiple media sources 2. The media content may be streamed from the media source 2 or may be sent to and stored (at least temporarily) at the player tracking device 38 for playback.

Figure 3A:
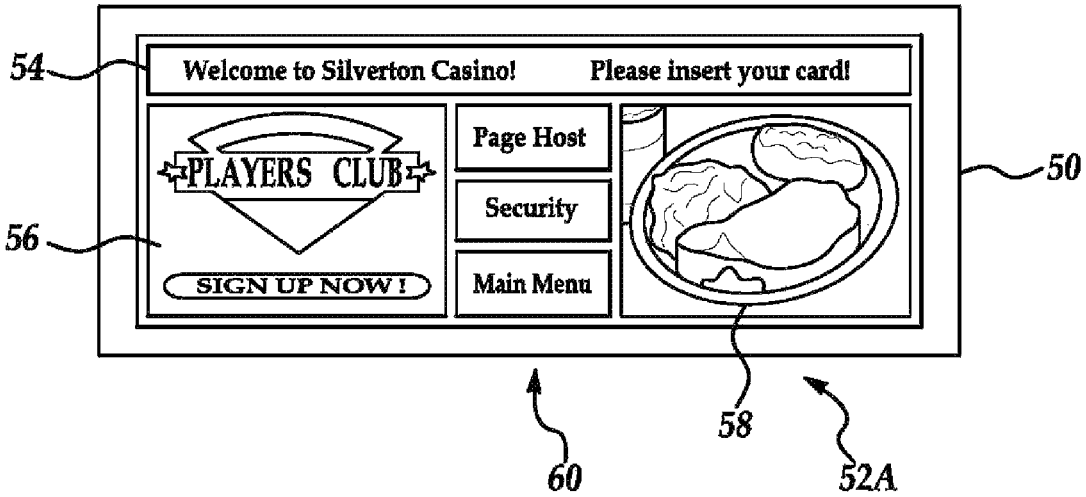
FIG. 3A is a diagrammatic illustration of an interface, according to an embodiment of the present invention.

With specific reference to FIG. 3A, a first sample screen image 52A is shown. The screen image 52A is shown within the bezel 50 and includes a title bar 54 with instructions to "insert your card", a player's club welcome image 56, an advertising media 58, and a plurality of buttons 60.

The player's club welcome image 56 may be player selectable which may cause the player tracking device 38 to display a screen or series of screens for allowing the player to enroll in the player tracking system. Alternatively, selection of the player's club welcome image may page a host (not shown) who could enroll the player in the player tracking club. The host may be enroll the player using a remote device (not shown).

The advertising media 58 may include an image and/or (live or streaming) video and/or audio media.

Figure 3B:
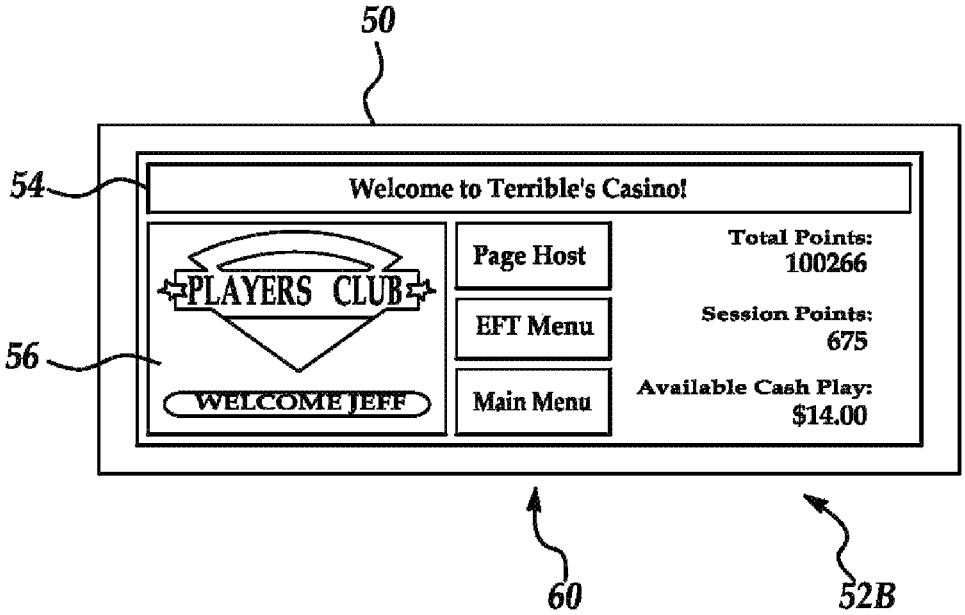
FIG. 3B is a diagrammatic illustration of an interface, according to an embodiment of the present invention.

The buttons 60 allow the player 24 to interact with the host computer 18. For example as shown in FIGS. 3A and 3B, buttons may be provided which allow the player 24 to page a host (a slot host or a drink hostess), page security (or security employee), or to navigate to a main menu (not shown).

In another aspect of the present invention, the player tracking device 38 allows the player 24 to interact with the player tracking system to view information and to interact with the player's account. For example with specific reference to FIG. 3B, once the player 24 has been identified to the player tracking system, the display may a bonus point total, a session bonus point total, and an available cash play.

Furthermore, as discussed above, the player tracking device 38 may display a list of vouchers assigned to the player 24. The player 24 may be allowed to select a voucher to download.

In another aspect of the present invention, the player tracking device 38 allows the player 24 to send and receive messages to a spouse, friend, or slot employee. The messages may be text and/or video and/or audio messages.

In another aspect of the present invention, the player tracking device 38 allows the player 24 to conference call a spouse, friend, or slot employee. The conference call may be text and/or video and/or audio messages.

In another embodiment, the, the media containing a machine glossary of terms.

In still another embodiment, the media may include a live video feed from a selected security camera.

Figure 3C:
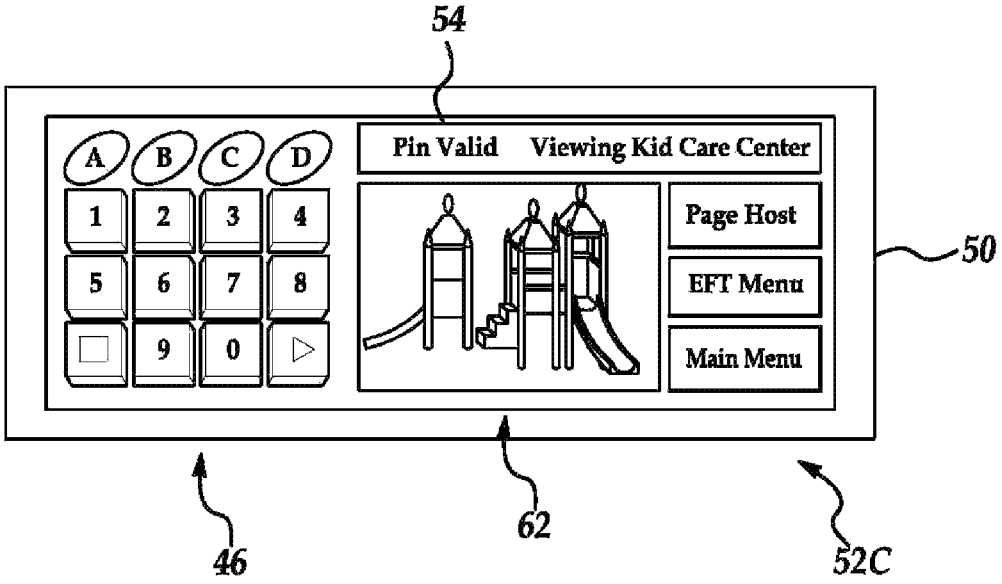
FIG. 3C is a diagrammatic illustration of an interface, according to an embodiment of the present invention; and, FIG. 3D is a diagrammatic illustration of an interface, according to an embodiment of the present invention.

With specific reference to FIG. 3C, in still another embodiment, the player tracking device 38 may provide a live video feed 62 of a remote location (not shown). For example, the remote location may be a childcare facility at which a child of the player 24 may be enrolled. In one embodiment, the player tracking device 38 for confirms that a child of the player 24 is enrolled at the child care facility through a personal identification number (PIN). If the PIN entered on the numeric or alpha-numeric keypad 46 is valid, the live feed 62 is played.

Figure 3D:
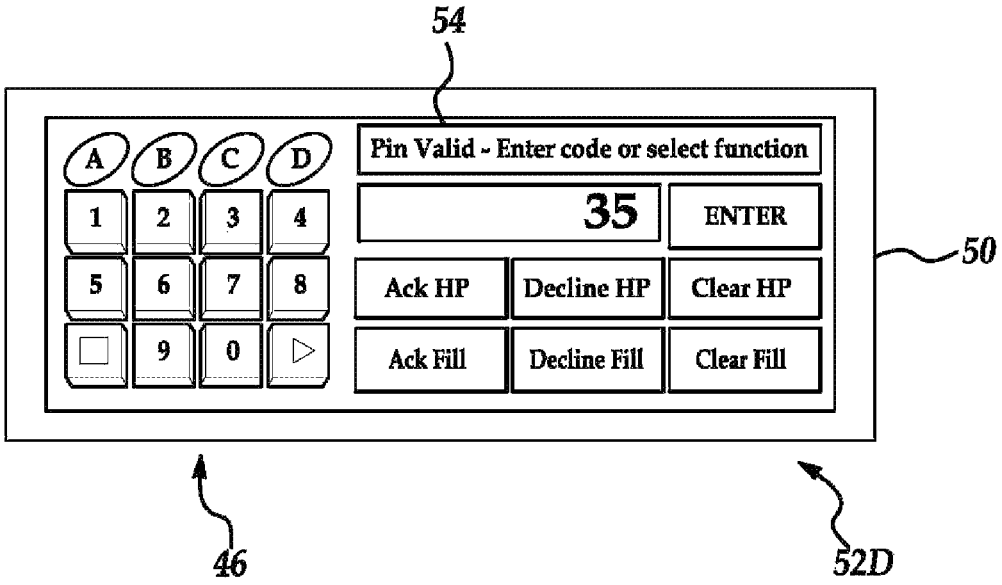

With reference to FIG. 3D, in a further aspect of the present invention, the player tracking device 38 may alert a technician in response to an error condition of the gaming machine 12. The player tracking device identifies the technician by an ID card inserted into the ID card reader and/or an identification number entered on the keypad 46. In one embodiment, the tracking device 38 may display technical instructions, e.g., repair instructions, or debugging information to the slot technician. The technical instructions or debugging information may be in the form of text, video, and/or audio.

In another embodiment, the keypad 46 may be used for entering repair or verification codes by user. With specific reference to FIG. 3D, the keypad 46 may be used to enter verification codes related to hopper fills or jackpot fills.

In one embodiment, the verification codes relate to the gaming machine 12 which is coupled to the player tracking device 38 on which the code is entered. In another embodiment, a verification code may be related to another of the gaming machines 12.

The system 10 and/or player tracking devices 38 may be utilized to display media content and/or media streams to a person, such as a patron, user, and employee of the casino or other location at which the gaming machine(s) 12 are located.

In one embodiment, the media content originates at one or more media source(s) 2. The media sources 2 may be any suitable type of source including one or more media servers and/or cameras and/or microphone for providing a live feed.

The media content may be played on the displays 44 and/or speakers 48 of the player tracking devices 38. However, it should be noted that the media content may also (or alternatively) be displayed or played on another display or speakers on the gaming machine or otherwise.

In one aspect of the present invention, a first media content is played on the display and/or speaker. A second media content replaces the first media content in response to receiving input.

For example, if no one is using or playing a gaming machine 12, then the player tracking device 38 may be playing media content which is aimed at attracting a player to play the gaming machine 12. This type of media content may be referred to as "attract media". Once the player tracking device 38 receives some type of input, then a second media content may be played on the player tracking device 38.

The input received may be any type of input that may signify that a player or employee has begun to use the gaming machine 12. Thus, the input may include, but not limited to, a message from the gaming machine 12, that money or credits have been input to the gaming machine 12, logging onto to the player tracking system 10 by a player or employee, i.e., is identified by and, actuation of a button on the touchscreen display 44, or actuation of any location on the touchscreen display 44.

The first and/or second media content may include, but are not limited to the following subject matter: local attractions, general in-house advertisements, paid advertisements by local merchants, show reviews, promotional alerts, security alerts, community service advisories, emergency directions, featured videos, and/or a Keno board. The media content may be of several types, including, but not limited to a static image, an animated gif file, audio, video, streaming text, text, casino messages, progressive info, and/or broadcast messages. Media content may be synchronous or asynchronous. Synchronous media is media that may be played simultaneously on more than one gaming machine 12 and is in-sync. Asynchronous media may start and stop at different times. Media, such as video, may be live, e.g., received directly from a camera or stored and played when desired.

The media content played on the player tracking device 38 may include video and/or audio and/or text, e.g., stock quotes.

The second media content may be (1) directed towards all carded players, i.e., players who have joined the player tracking program; (2) predefined groups of players; (3) player(s) meeting predefined criteria; (4) single players; or (5) all players.

In another embodiment, an intermediate content may be played prior to play or display of the second media content. The intermediate content may be a more generalized message, such as an advertisement to all players.

As discussed above, the second media content being a function of the identification of the person. For example, carded players and/or employees may receive media content based on the group or groups to which they belong (as designated in the database). The media content may also be based on one or more criteria specified in the database for the person logging in, e.g., personal interests.

If the player is not a member of the player tracking club, or otherwise does not log in, the media content may be designated as pertaining to that group of persons.

In another aspect of the present invention, the player tracking device 38 may allow the player or person to change between media contents. For example, the system 10 may provide different "channels" which the player or patron may access, typically, through the keypad 46.

In another aspect of the present invention, a gaming system having a media source 2 and a plurality of gaming machines 12 is provided. The media source 2 provide first and second media content streams. Generally, the first and second media content streams are synchronized. In other words, if two gaming machines 12 are playing the same media content stream, they are synchronized.

One or more of the gaming machines 12, i.e., a first subset thereof, may be playing the first media content stream. One or more other of the gaming machines 12, i.e., a second subset thereof, may be playing the second media content stream.

In one embodiment, the player, patron or employee may switch between the media content streams through actuation of the keypad 46.

In one aspect, the second media content stream may be a function of the identification (or lack thereof) of the player and/or player information in the database. For example, the media content stream may be a function of a group or groups to which a player or patron belongs. Or the media content stream may be a function of one or more characteristics of the player.

Obviously, many modifications and variations of the present invention are possible in light of the above teachings. The invention may be practiced otherwise than as specifically described within the scope of the appended claims.

What is claimed is:

1. A player tracking device for providing a player interface to a plurality of users of a plurality of gaming machines and displaying media from a media source, the plurality of users including a plurality of tracked players, a plurality of non-tracked players, and a plurality of employees, the media source providing a plurality of video streams including a plurality of media content, player information relating to the plurality of tracked players being included in a player tracking system being stored in a host computer, the player information including at least one group of player, where the players may either be within or not within the at least one group of players, each of the gaming machines including a coin-bill management device which accepts physical media associated with a monetary value to establish a credit balance, a display unit for displaying a game, and a gaming controller configured to receive a signal indicative of a wager from a player via the input device, adjust the credit balance as a function of the wager, and initiate the game, the player tracking device coupled to one of the gaming machines, comprising:

a processor;

an ID Card reader coupled to the processor;

a speaker coupled to the processor for playing audio;

a display coupled to the processor for displaying information and displaying media; and, a keypad coupled to the processor for receiving input from one of the users, the input being used to establish if the one of the users is a member of at least one of the plurality of tracked players and the plurality of employees, the processor configured to:

display a first video stream on the display device when the player tracking device and the gaming machine are not being used, the first video stream including media for attracting a player to the gaming machine;

detect an initial input received from a user of the plurality of users via the gaming machine and responsively replace the first video stream with a second video stream, the second video stream including a request message, the request message being selectable by the user via the display device and including a request to input a user identification;

receive a user's selection of the request message from the user via the display device, identify the user as a non-tracked player in response to the received selection, and replace the second video stream with a third video stream, the third video stream including a screen for allowing the non-tracked player to enroll in the player tracking system being stored in the host computer;

receive a user identification input from the user via the ID Card reader, identify the user as being included in one of the plurality of tracked players and the plurality of employees as a function of the received user identification input, and responsively replace the second video stream with a fourth video stream, the fourth video stream including media content being determined as a function of the identified user; and if the user is a player that is a member of the plurality of tracked players, the processor for responsively establishing an identity of one of the tracked players as a function of the user identification input and for displaying the fourth video stream having a first media content as a function of the identity of the tracked player, and if the user is a member of the plurality of employees, the processor for responsively establishing an identity of one of the employees as a function of the user identification input and for displaying the fourth video stream having a second media content as a function of the established employee identity.

2. A player tracking device, as set forth in claim 1, the display being a touch-screen display.

3. A player tracking device, as set forth in claim 2, the keypad being implemented by the touch-screen display.

4. A player tracking device, as set forth in claim 1, wherein at least one of the first and the second video streams includes at least one of local attractions, general in-house advertisements, paid advertisements by local merchants, show reviews, promotional alerts, security alerts, community service advisories, emergency directions, featured videos, and a Keno board.

5. A player tracking device, as set forth in claim 1, further comprising a speaker, at least one of the first and the second video streams including audio for playing through the speaker.

6. A player tracking device, as set forth in claim 1, the host computer for managing a database containing player information and employee information, the processor for establishing identification of at least one of a player and an employee through at least one of the keypad and the ID reader.

7. A player tracking device, as set forth in claim 1, the processor for playing an intermediate media content prior to display of the second video stream upon detecting the initial input from the user, the intermediate content including an advertisement.

8. A player tracking device, as set forth in claim 1, the second media content including technical instructions including an error code being associated with another one of the gaming machines.

9. A player tracking device, as set forth in claim 1, the processor configured to receive synchronous attract media from the media source and to display the first video stream including the synchronous attract media such that the attract media is simultaneously displayed with the plurality of gaming machines.

10. A player tracking device, as set forth in claim 1, wherein the first and second video streams are one of live video and stored video.

11. A player tracking device, as set forth in claim 1, the first media content including live video feed of a remote location via a security camera.

12. A player tracking device, as set forth in claim 1, wherein the input is actuation of a key on the keypad.

13. A gaming system, comprising:

a media source for providing a plurality of video streams including media content;

a host computer coupled to the media source for storing information related to a plurality of tracked players and an plurality of employees, the player information including at least one group of players, where each player may either be within or not within the at least one group of players; and, a plurality of gaming machines coupled to the host computer, each of the gaming machines including a coin-bill management device which accepts physical media associated with a monetary value to establish a credit balance, a display unit for displaying a game, and a gaming controller configured to receive a signal indicative of a wager from a player via the input device, adjust the credit balance as a function of the wager, and initiate the game, each gaming machine having a player tracking device capable to play media and to receive input from a plurality of users, the media source and the plurality of gaming machines being networked together, wherein each player tracking device includes:

a processor;

an ID reader coupled to the processor;

a display coupled to the processor for displaying information and displaying media; and, a keypad coupled to the processor for receiving input from one of the users, the input being used to establish if the one of the users is a member of at least one of the plurality of tracked players and the plurality of employees, the processor configured to:

display a first video stream on the display device when the player tracking device and the gaming machine are not being used, the first video stream including media for attracting a player to the gaming machine;

detect an initial input received from a user of the plurality of users via the gaming machine and responsively replace the first video stream with a second video stream, the second video stream including a request message, the request message being selectable by the user via the display device and including a request to input a user identification;

receive a user's selection of the request message from the user via the display device, identify the user as a non-tracked player in response to the received selection, and replace the second video stream with a third video stream, the third video stream including a screen for allowing the non-tracked player to enroll in a player tracking system being stored in the host computer;

receive a user identification input from the user via the ID Card reader, identify the user as being included in one of the plurality of tracked players and the plurality of employees as a function of the received user identification input, and responsively replace the second video stream with a fourth video stream, the fourth video stream including media content being determined as a function of the identified user; and if the user is a player that is a member of the plurality of tracked players, the processor for responsively establishing an identity of one of the tracked players as a function of the user identification input, responsively establishing whether the player is within the at least one group of players, displaying the fourth video stream having a first media content as a function of the identity of the tracked player, if the user is a member of the plurality of employees, the processor for responsively establishing an identity of the one of the employees as a function of the user identification input and for displaying the fourth video stream having a second media content as a function of the established employee identity.

14. A gaming system, as set forth in claim 13, the display being a touch-screen display.

15. A gaming system, as set forth in claim 14, the keypad being implemented by the touch-screen display.

16. A gaming system, as set forth in claim 13, wherein at least one of the first and the second video streams includes at least one of local attractions, general in-house advertisements, paid advertisements by local merchants, show reviews, promotional alerts, security alerts, community service advisories, emergency directions, featured videos, and a Keno board.

17. A gaming system, as set forth in claim 13, the media source configured to transmit the first video stream to each of the plurality of player tracking devices, the first video stream including synchronous attract media that is simultaneously displayed on each of the player tracking devices.

18. A gaming system, as set forth in claim 13, the host computer for managing a database containing player information and employee information, the processor for establishing identification of at least one of a player and an employee through at least one of the keypad and the ID reader.

19. A gaming system, as set forth in claim 13, the processor for playing an intermediate media content prior to display of the second video stream upon detecting the initial input from the user, the intermediate content including an advertisement.

20. A gaming system, as set forth in claim 13, the second media content including technical instructions including an error code being associated with another one of the gaming machines.

* * * * *